US010369818B2

(12) United States Patent
Shomura et al.

(10) Patent No.: US 10,369,818 B2
(45) Date of Patent: Aug. 6, 2019

(54) RECORDING APPARATUS

(71) Applicant: SEIKO EPSON CORPORATION, Tokyo (JP)

(72) Inventors: Hikari Shomura, Inzai (JP); Kazunori Mori, Matsumoto (JP); Satoshi Negishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/991,276

(22) Filed: May 29, 2018

(65) Prior Publication Data

US 2018/0345694 A1 Dec. 6, 2018

(30) Foreign Application Priority Data

May 31, 2017 (JP) ..... 2017-108282
Sep. 25, 2017 (JP) ..... 2017-183887

(51) Int. Cl.

| | |
|---|---|
| ***B41J 13/00*** | (2006.01) |
| ***B41J 3/60*** | (2006.01) |
| ***B41J 11/00*** | (2006.01) |
| ***B41J 11/06*** | (2006.01) |
| ***B41J 13/02*** | (2006.01) |

(Continued)

(52) U.S. Cl.

CPC ..... *B41J 13/0045* (2013.01); *B41J 3/60* (2013.01); *B41J 11/0005* (2013.01); *B41J 11/0045* (2013.01); *B41J 11/06* (2013.01); *B41J 13/02* (2013.01); *B65H 29/60* (2013.01); *B65H 29/70* (2013.01)

(58) Field of Classification Search

CPC . B41J 13/0045; B41J 13/02; B41J 3/60; B41J 11/0045; B41J 11/06; B41J 11/0005; B65H 29/70; B65H 29/60

See application file for complete search history.

(56) References Cited

U.S. PATENT DOCUMENTS

2005/0024463 A1 2/2005 Kida
2012/0018948 A1 1/2012 Oshima et al.

(Continued)

FOREIGN PATENT DOCUMENTS

JP 2011-157189 A 8/2011
JP 2012-025525 A 2/2012

(Continued)

OTHER PUBLICATIONS

European Search Report issued in Application No. 18173413 dated Oct. 16, 2018.

*Primary Examiner* — Kristal Feggins
(74) *Attorney, Agent, or Firm* — Workman Nydegger

(57) ABSTRACT

A printer includes a corrugating section disposed on an upstream side of a line head, the corrugating section being configured to alternately form crests and troughs in a sheet in a width direction which intersects a medium transport direction, a relaxing section that can be switched between a relaxing position in which the corrugations formed by the corrugating section are relaxed and a maintaining position in which the corrugations are maintained with respect to the sheet on a downstream side of the line head between the line head and branch points of transport paths and a controller configured to control the switching of the relaxing section between the relaxing position and the maintaining position. The controller switches the relaxing section depending on a transport destination of the recorded sheet.

12 Claims, 14 Drawing Sheets

(51) Int. Cl.
*B65H 29/60* (2006.01)
*B65H 29/70* (2006.01)

(56) References Cited

U.S. PATENT DOCUMENTS

2013/0135411 A1 5/2013 Ito et al.
2014/0253656 A1 9/2014 Ito et al.

FOREIGN PATENT DOCUMENTS

JP 2013-111838 A 6/2013
JP 2013111838 A 6/2013

RECORDING APPARATUS

INCORPORATED BY REFERENCE

The entire disclosure of Japanese Patent Application Nos. 2017-108282, filed May 31, 2017 and 2017-183887, filed Sep. 25, 2017 is expressly incorporated by reference herein.

BACKGROUND

1. Technical Field

The present disclosure relates to a recording apparatus for recording onto a medium.

2. Related Art

Recording apparatuses such as ink jet printers are provided with a medium support section (also referred to as a platen) at a position facing a recording unit for recording onto paper, which is an example medium. The medium support section supports the paper so as to define a distance (also referred to as a platen gap) between the recording unit and the paper.

Some of the recording apparatuses form corrugation (also referred to as cockling), which is wrinkling of paper in a direction intersecting the medium transport direction, of the paper before the printing operation by the recording unit in order to prevent the paper on the medium support section from being deformed. The corrugated paper becomes to have increased stiffness and becomes stable on the medium support section. Accordingly, the recording unit can provide high-quality images. Furthermore, the decrease in quality of recorded images on paper due to rubbing against the recording unit can be prevented.

Some of the recording apparatuses include, as transport paths to be used after recording by the recording unit, a linear straight path and, for example, a curved path for reversing the recording side for two-sided recording. When corrugated paper is transported in the curved path, the paper tends to be caught in the curved path due to the stiffness increased by the corrugations and a paper jam may occur in the curved path.

To reduce the risk of a paper jam in the curved path, JP-A-2013-111838 discloses a recording apparatus that includes contact portions 83 for forming undulations (corrugations) in paper before the recording by a recording unit and a projecting portion 34 for reducing the undulations of paper provided on an upstream side of a curved path (a reverse transport path 67 in JP-A-2013-111838) to which the recorded paper is to be transported. In JP-A-2013-111838, when the recorded paper is not transported to the reverse transport path 67, the paper is transported straight from the area the recording has been performed by a recording head 39 and discharged onto a discharge tray 20. In the transport path from the recording area by the recording head 39 to the discharge tray 20, no projecting portion 34 is provided, and thus the paper is discharged onto the discharge tray 20 while the undulations formed before the recording are maintained.

Another recording apparatus includes, in addition to a path such as the reverse transport path 67 for two-sided recording in JP-A-2013-111838, as the curved path to which recorded paper is to be transported, a curved reversing path for reversing the recording side of the recorded paper downward, that is, for discharging the paper in a so-called face-down state. In JP-A-2013-111838, the projecting portion 34 that serves as a decorrugation mechanism is provided in the reverse transport path 67. Accordingly, for example, if a recording apparatus includes a plurality of curved paths, it is necessary to provide the decorrugation mechanism (projecting portion 34) for each curved path. This increases the number of components and complicates the structure.

In a recording apparatus having a straight path and a curved path as transport paths for recorded paper, in some cases, the corrugation state is to be changed depending on the transport paths. For example, for the straight path, it is preferable to maintain the corrugations to keep the stiffness to transport the paper. On the other hand, for the curved path, it is preferable to relax the corrugations to reduce the stiffness to transport the paper.

SUMMARY

An advantage of some aspects of the disclosure is that there is provided a recording apparatus capable of readily selecting whether to relax or maintain corrugations formed in a medium before recording depending on a transport destination to which the medium is to be transported after recording with a simple structure.

A recording apparatus according to an aspect of the disclosure for solving the above-mentioned problems includes a recording section configured to discharge a liquid onto a transported medium for recording, a corrugating section disposed on an upstream side of the recording section in a medium transport direction, the corrugating section being configured to alternately form crests and troughs in the medium in a width direction which intersects the medium transport direction, a plurality of post-recording transport paths disposed on a downstream side of the recording section, the post-recording transport paths having different destinations for the recorded medium, a relaxing section that can be switched between a relaxing position in which the corrugations formed by the corrugating section are relaxed and a maintaining position in which the corrugations are maintained with respect to the medium between the recording section and branch points of the post-recording transport paths in the medium transport direction, and a controller configured to control the switching of the relaxing section between the relaxing position and the maintaining position. The controller switches the relaxing section depending on to which one of the post-recording transport paths the recorded medium is to be transported.

According to this aspect, a relaxing section that can be switched between a relaxing position in which the corrugations formed by the corrugating section are relaxed and a maintaining position in which the corrugations are maintained with respect to the medium between the recording section and branch points of the post-recording transport paths in the medium transport direction is provided, and the controller switches the relaxing section depending on to which one of the post-recording transport paths the recorded medium is to be transported. Consequently, depending on to which one of the post-recording transport paths the recorded medium is to be transported, whether to relax or maintain the corrugations of the medium can be selected. In other words, the only one relaxing section is enough for the post-recording transport paths, and thus the corrugations of the medium can be readily set depending on the shapes of the post-recording transport paths or the transport destination with the simple structure. It should be noted that the expression the relaxing section "relaxes the corrugations" includes not only to reduce and smooth the differences between the crests and troughs of the corrugations but also includes to completely release the corrugations or at least to relax the medium even if the shapes of the corrugations are not changed at all.

It is preferable that the controller set the relaxing section to the relaxing position when the post-recording transport path to which the recorded medium is to be transported includes a curved path for curving and transporting the medium.

The corrugated medium tends to be caught in the transport path in transporting the medium in the curved path and a paper jam may occur. According to this structure, the controller sets the relaxing section to the relaxing position when the post-recording transport path to which the recorded medium is to be transported includes a curved path for curving and transporting the medium. Consequently, in the post-recording transport path that includes the curved path, a jam due to the corrugations of the medium can be prevented.

It is preferable that the relaxing section include a plurality of relaxing-section drive rollers that are disposed at predetermined intervals in the width direction and a plurality of relaxing-section driven rollers that are disposed to correspond to the relaxing-section drive rollers to come into contact with the relaxing-section drive rollers to be driven, the controller bring the relaxing-section driven rollers into contact with the relaxing-section drive rollers to set the relaxing section to the maintaining position, and bring the relaxing-section driven roller at a central section among the relaxing-section driven rollers in the width direction into contact with the relaxing-section drive roller and separates the relaxing-section driven rollers at end portion sides in the width direction from the relaxing-section drive rollers to set the relaxing section to the relaxing position.

With this structure, by using the relaxing section including a plurality of relaxing-section drive rollers that are disposed at predetermined intervals in the width direction and a plurality of relaxing-section driven rollers that are disposed to correspond to the relaxing-section drive rollers to come into contact with the relaxing-section drive rollers to be driven, the corrugations of the medium can be relaxed or maintained. The controller can bring the relaxing-section driven rollers into contact with the relaxing-section drive rollers to set the relaxing section to the maintaining position, and bring the relaxing-section driven roller at a central section among the relaxing-section driven rollers in the width direction into contact with the relaxing-section drive roller and separates the relaxing-section driven rollers at end portion sides in the width direction from the relaxing-section drive rollers to set the relaxing section to the relaxing position. With this structure, the nipping on the end portion sides of the medium by the roller pairs as the relaxing section is released and thus the corrugations of the medium can be released toward the end portion sides and the corrugations of the medium can be relaxed.

It is preferable that the relaxing section include a plurality of relaxing-section roller pairs that have the relaxing-section drive rollers and the relaxing-section driven rollers that come into contact with the relaxing-section drive rollers to be driven and rotated at predetermined intervals in the width direction such that the predetermined intervals can be changed, and the controller perform control to widen the predetermined intervals of the relaxing-section roller pairs that are nipping the medium to switch the relaxing section from the maintaining position to the relaxing position.

With this structure, the controller performs control to widen the predetermined intervals of the relaxing-section roller pairs that are nipping the medium to switch the relaxing section from the maintaining position to the relaxing position. Consequently, the corrugations of the medium are stretched in the width direction and the corrugations can be released.

It is preferable that the recording apparatus include a downstream-side transport section disposed on the downstream side of the recording section in the medium transport direction, and the relaxing-section drive rollers and the relaxing-section driven rollers in the relaxing section also serve as the downstream-side transport section.

In this structure, the relaxing section also serves as the downstream-side transport section, and thus the number of components can be reduced, and cost reduction and space saving can be achieved.

It is preferable that the switching of the relaxing section from the maintaining position to the relaxing position by the controller be performed after the recording onto the medium by the recording section has completed.

If the relaxing section that also serves as the downstream-side transport section is switched from the maintaining position to the relaxing position during the recording onto the medium, the quality of the image recorded on the medium may be affected. With this structure, the switching of the relaxing section from the maintaining position to the relaxing position by the controller is performed after the recording onto the medium by the recording section has completed, and thus the effect on the quality of the image recorded on the medium caused by the switching of the relaxing section that also serves as the downstream-side transport section to the relaxing position can be reduced.

It is preferable that the relaxing-section drive rollers be disposed at positions corresponding to the crests of the corrugations formed in the medium by the corrugating section when the relaxing section is in the maintaining position.

With this structure, the relaxing-section drive rollers are disposed at positions corresponding to the crests of the corrugations formed in the medium by the corrugating section when the relaxing section is in the maintaining position. Accordingly, when the relaxing section is in the maintaining position, the corrugations of the medium can be further stably maintained.

It is preferable that the relaxing section include a plurality of relaxing-section roller pairs that have the relaxing-section drive rollers and the relaxing-section driven rollers that come into contact with the relaxing-section drive rollers to be driven and rotated at predetermined intervals in the width direction, a rotation shaft of the relaxing-section roller pairs be inclined such that as the relaxing-section roller pairs are closer to the end portion sides in the width direction, the medium is transported outward in the width direction, and the controller separate the relaxing-section driven rollers from the relaxing-section drive rollers to set the relaxing section to the maintaining position and bring the relaxing-section driven rollers into contact with the relaxing-section drive rollers to set the relaxing section to the relaxing position.

In this structure, a plurality of relaxing-section roller pairs in the relaxing section are configured such that a rotation shaft is inclined outward in the width direction as the relaxing-section roller pairs are closer to the end portion sides in the width direction. Consequently, the medium is transported to be stretched outward in the width direction when the relaxing-section driven rollers are brought into contact with the relaxing-section drive rollers, and the corrugations formed in the medium can be relaxed. The controller separates the relaxing-section driven rollers from the relaxing-section drive rollers to set the relaxing section to the maintaining position and bring the relaxing-section driven rollers into contact with the relaxing-section drive rollers to set the relaxing section to the relaxing position. Accordingly, the corrugations of the medium can be set depending on the shapes of the post-recording transport paths or the transport destination.

It is preferable that the relaxing section, in the relaxing position, protrude from the transport path from an opposite side of the recording side of the medium to come into contact with the medium and in the maintaining position, retract from the transport path.

In this structure, when the relaxing section is in the relaxing position, the relaxing section protrudes from the transport path from an opposite side of the recording side of the medium to come into contact with the medium. Consequently, the corrugated medium can be transported in the path that has been narrowed in the height direction, and thereby the corrugations of the medium can be relaxed. Furthermore, the relaxing section can be readily switched between the maintaining position and the relaxing position.

It is preferable that the relaxing section be a swing member having a pivot shaft on the upstream side in the medium transport direction, and the swing member extend from the pivot shaft side toward the downstream side in the medium transport direction in the width direction and a central section in the width direction become higher toward the downstream side in the medium transport direction.

With this structure, when the relaxing section is set to the relaxing position, the corrugations in the medium can be effectively relaxed.

It is preferable that the relaxing section include a plurality of swing members at positions corresponding to the crests of the corrugations in the medium at predetermined intervals.

With this structure, when the relaxing section is set to the relaxing position, the corrugations in the medium can be further effectively relaxed.

It is preferable that among the swing members in the relaxing section, the swing members that are close to the central section in the width direction be disposed on the upstream side in the medium transport direction and the swing members close to the end portion sides in the width direction be disposed on the downstream side in the medium transport direction.

With this structure, when the relaxing section is set to the relaxing position, the corrugations in the medium can be further effectively relaxed.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Figure 1:
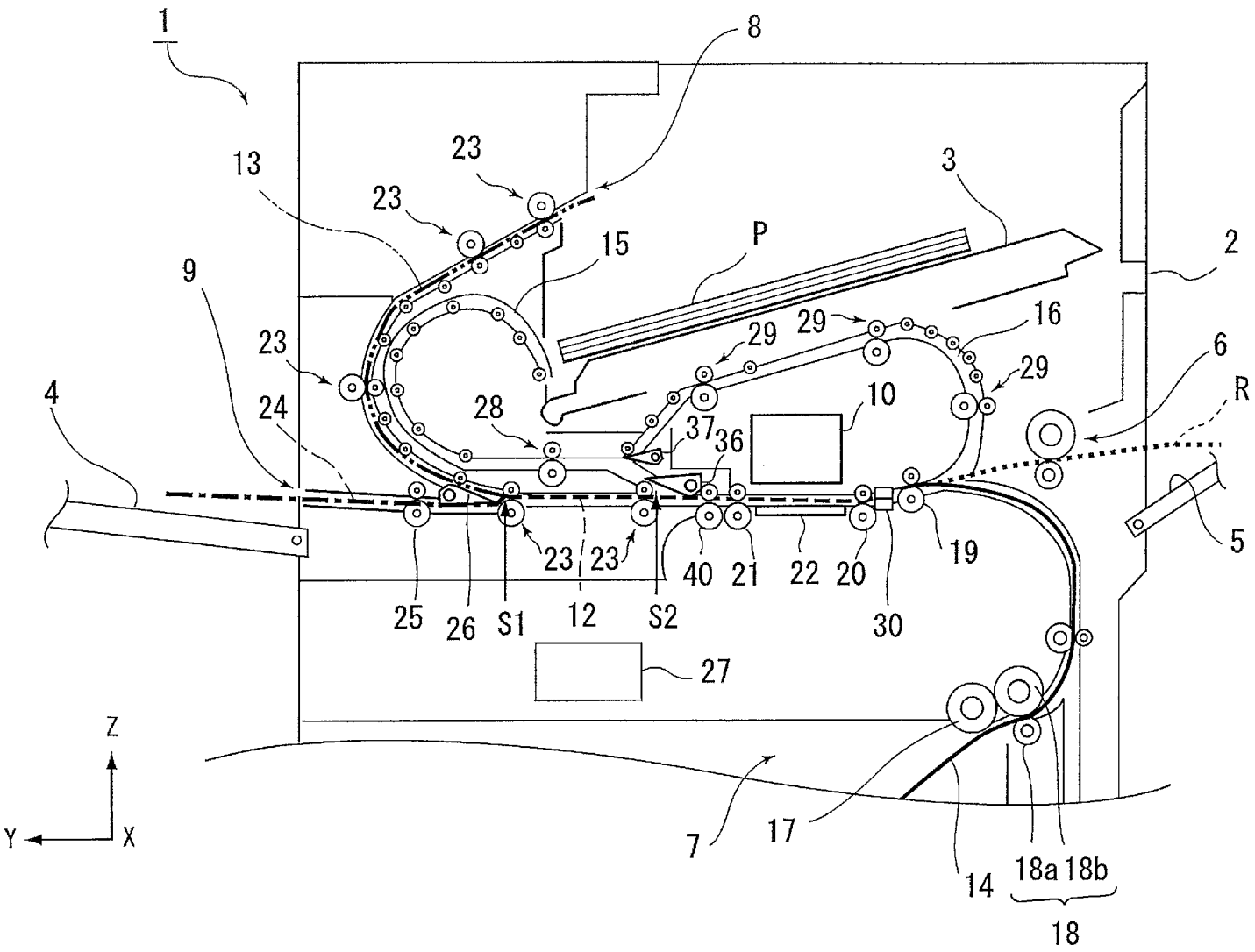
FIG. 1 is a schematic structural view of a sheet transport path in a printer according to a first embodiment.
Figure 2:
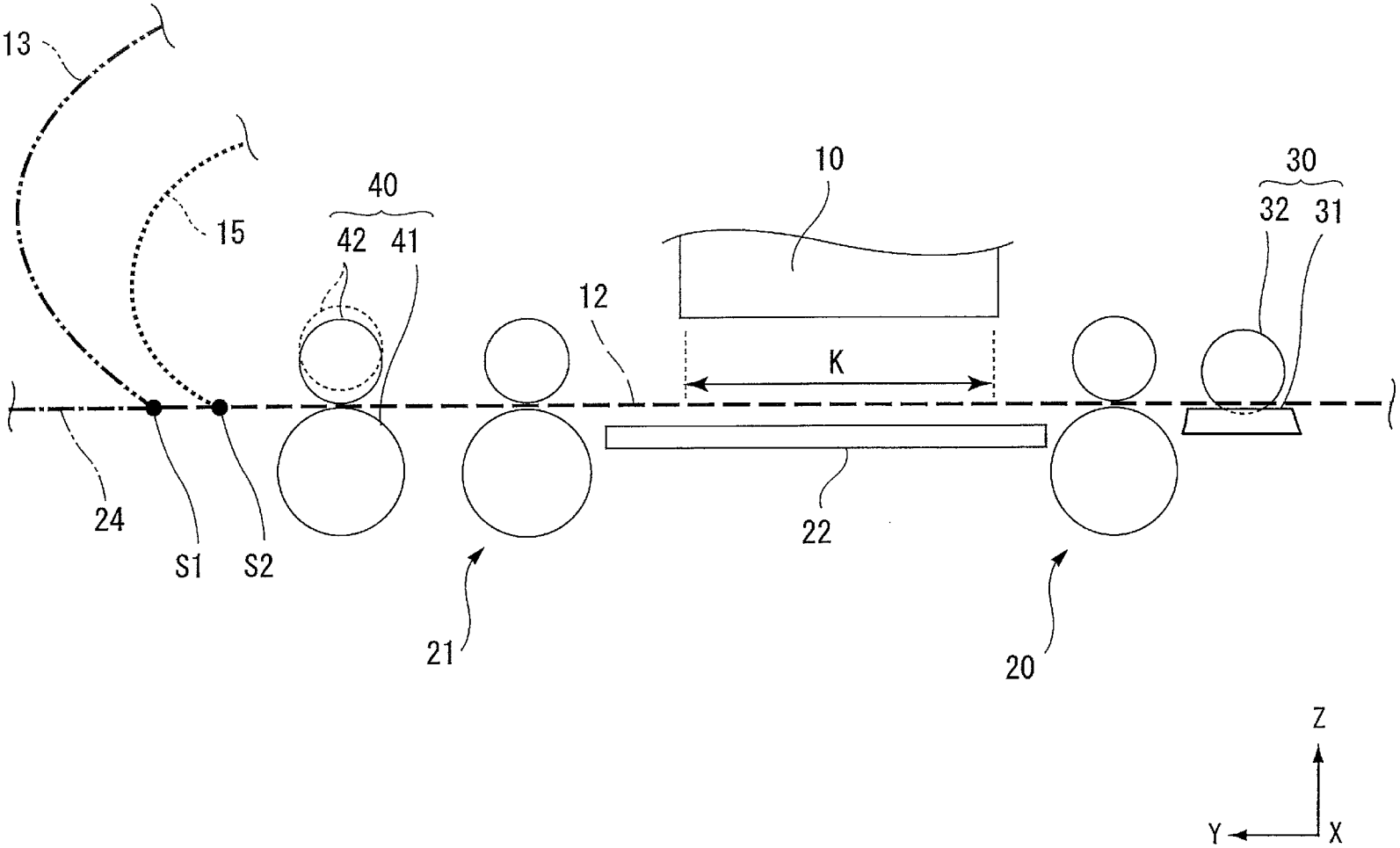
FIG. 2 is a schematic side view of a recording section and peripheral elements.
Figure 3:
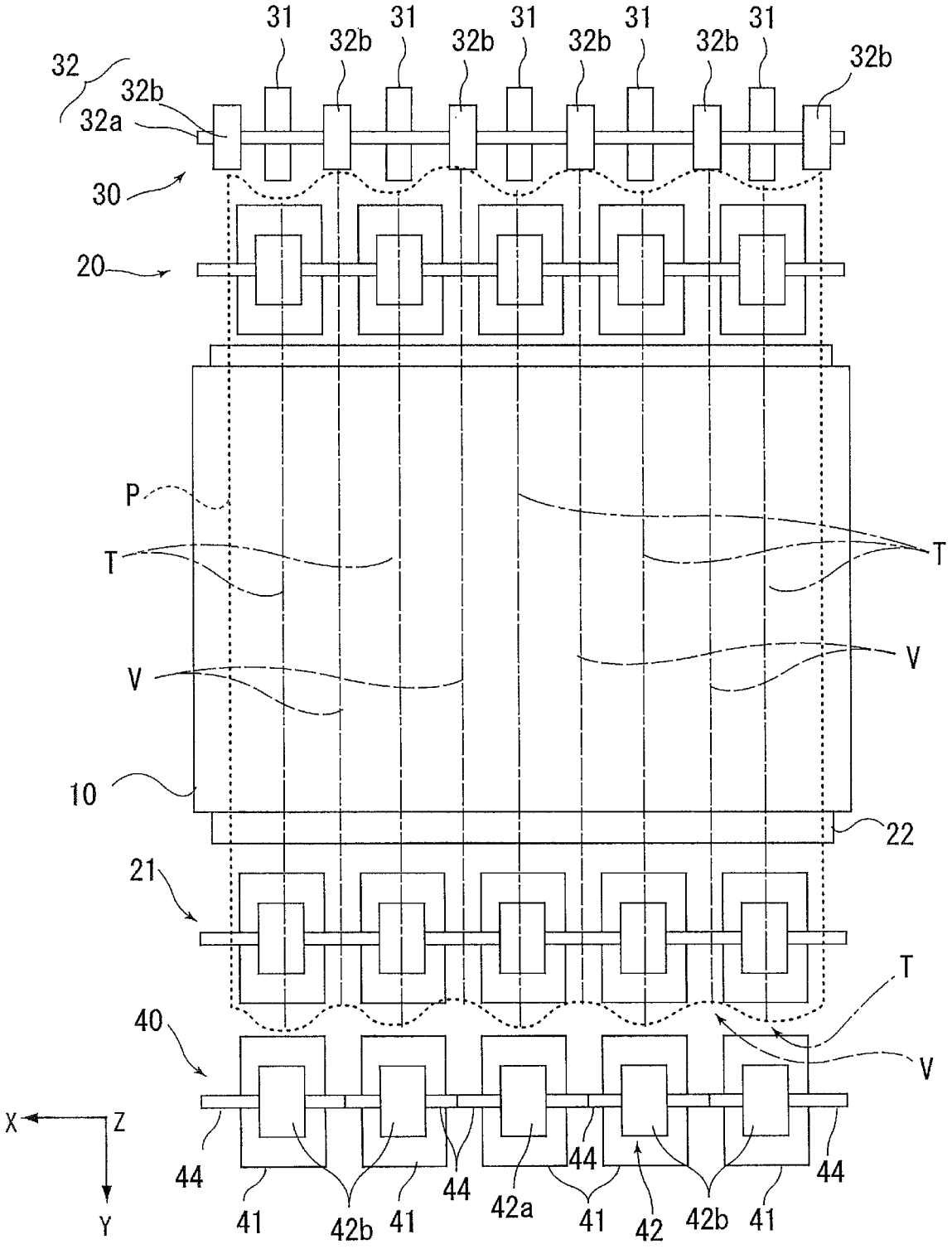
FIG. 3 is a schematic plan view of the recording section and peripheral elements.
Figure 4:
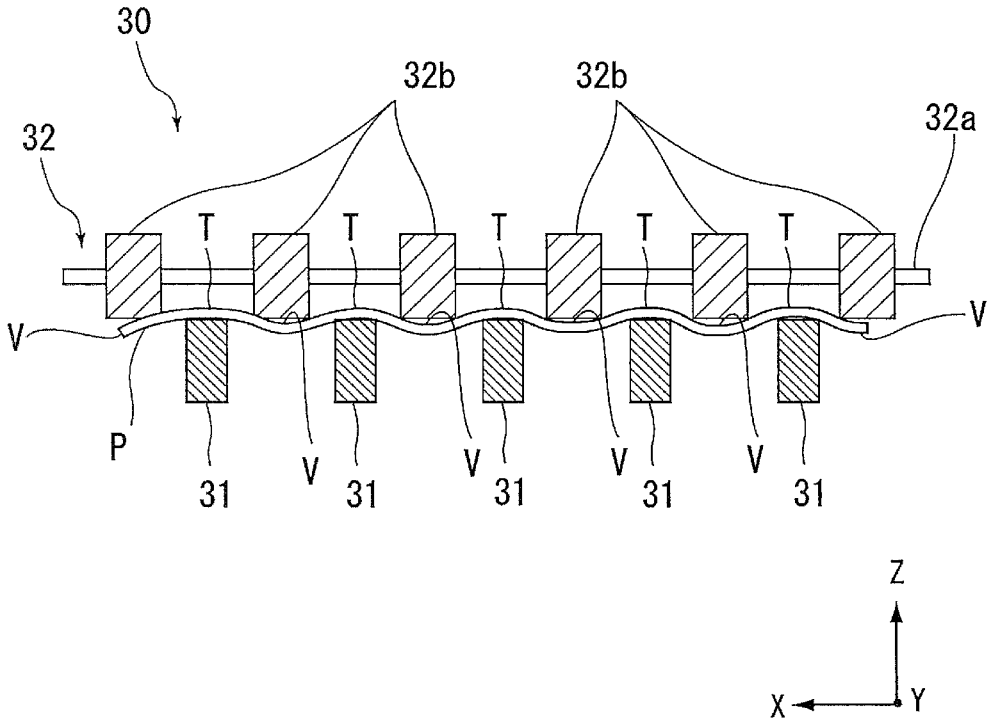
FIG. 4 is a cross-sectional view of a ZX plane of a corrugating section according to the first embodiment.
Figure 5:
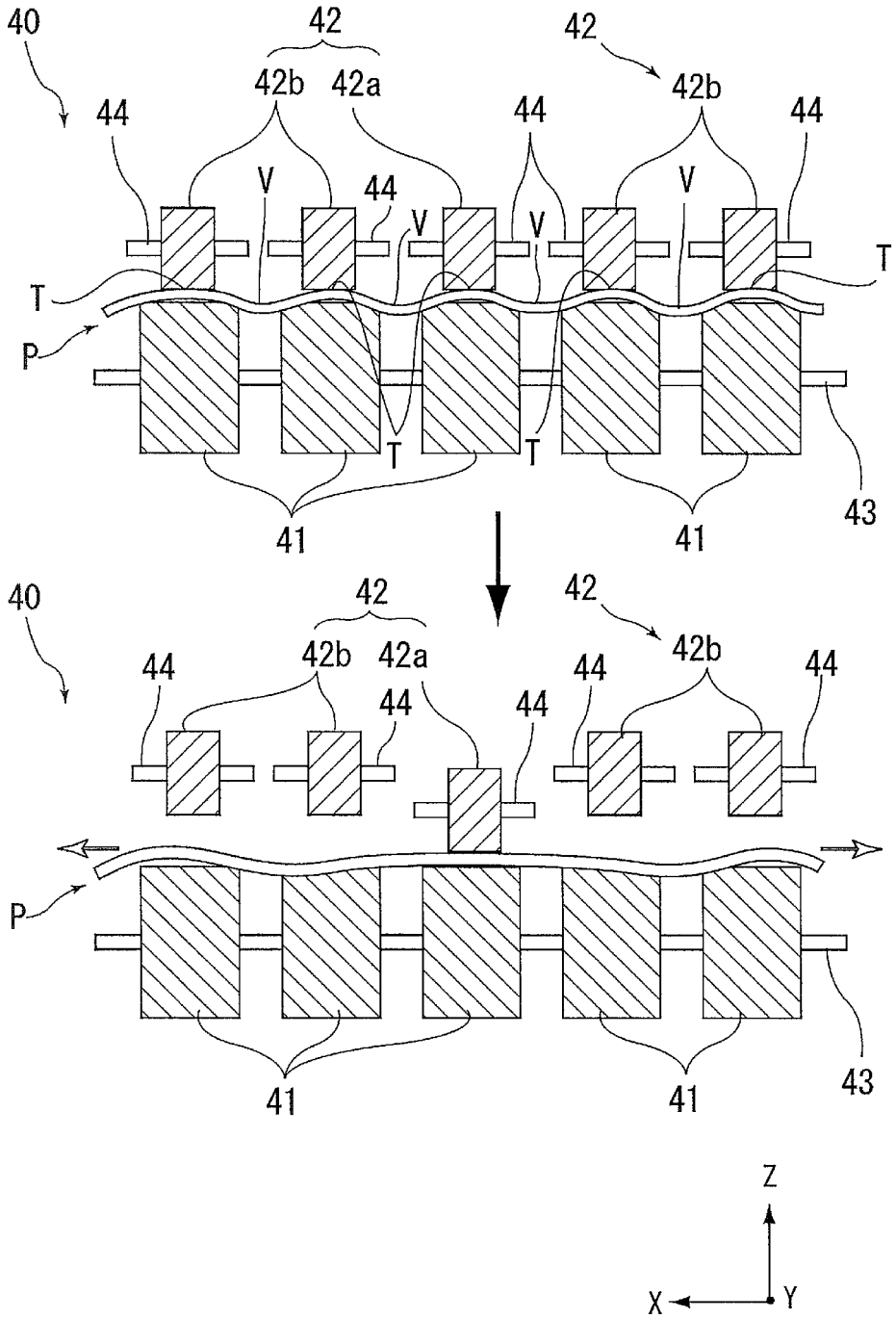
FIG. 5 is a cross-sectional view of a ZX plane of a relaxing section according to the first embodiment.
Figure 6:
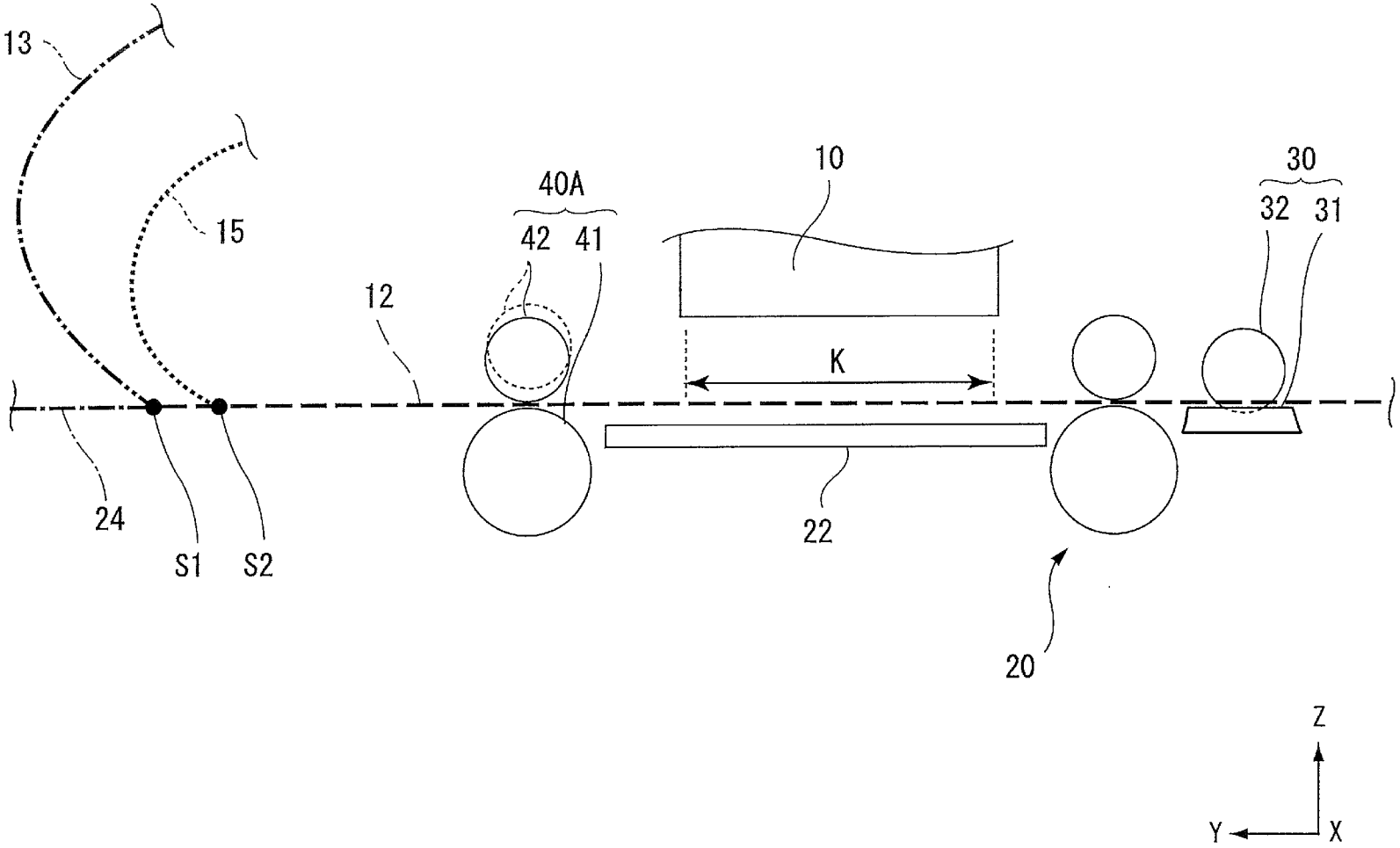
FIG. 6 is a modification of the relaxing section according to the first embodiment.

First, an outline of a recording apparatus according to a first embodiment of the disclosure will be described. An ink jet printer 1 (hereinafter, also simply referred to as a printer 1) will be described as an example recording apparatus according to the embodiment. FIG. 1 is a schematic view of a sheet transport path in the printer according to the first embodiment. FIG. 2 is a schematic side view of a recording section and peripheral elements. FIG. 3 is a schematic plan view of the recording section and peripheral elements. FIG. 4 is a cross-sectional view of a ZX plane of a corrugating section according to the first embodiment. FIG. 5 is a cross-sectional view of a ZX plane of a relaxing section according to the first embodiment. FIG. 6 is a modification of the relaxing section according to the first embodiment.

In an X-Y-Z coordinate system in each drawing, an X-axis direction denotes a width direction of a sheet, that is, an apparatus depth direction, a Y-axis direction denotes a sheet transport direction (medium transport direction) in a transport path in the recording apparatus, that is, an apparatus width direction, and a Z-axis direction denotes an apparatus height direction. The direction toward which a sheet is transported is referred to as a downstream direction and the opposite direction is referred to as an upstream direction.

Outline of Printer

The printer 1 in FIG. 1 is provided in an apparatus body 2. The printer 1 includes a line head 10, which is an example "recording section" for discharging a liquid onto a sheet, which is an example "medium". In this embodiment, the liquid is a water-based ink such as an aqueous ink. The printer 1 can perform two-sided printing in which recording is performed on a first side (also referred to as a front side) of a sheet, the sheet is reversed, and then, recording is performed on a second side (also referred to as a back side).

A plurality of sheet storage cassettes 7 are provided in a lower part of the printer 1. The sheet stored in the sheet storage cassette 7 is transported toward the line head 10 and onto which recording operation is performed. The sheet that has been recorded by the line head 10 is discharged either a first discharge section 8, which is used to stack sheets onto a first medium mounting section 3 that is provided above the line head 10, or a second discharge section 9, which is used to stack sheets onto a second medium mounting section 4 that is provided on a side surface in the +Y-axis direction.

Transport Paths in Printer

Sheet transport paths in the printer 1 will be described with reference to FIG. 1. In the following description, a transport path for directly discharging a sheet after the completion of the recording on the first side will be described, and then a transport path to be used in two-sided printing will be described.

The sheet storage cassette 7 can store a plurality of sheets, and the uppermost sheet is transported toward a feeding path 14 (shown by the bold solid line in FIG. 1) on the downstream side in the medium transport direction. On the feeding path 14, a feeding roller 17 and a separation roller pair 18 for separating a plurality of sheets one by one are disposed along the medium transport direction in this order. The feeding roller 17 is driven and rotated by a drive source (not illustrated). The separation roller pair 18 is also referred to as retard rollers, and includes a drive roller 18*b*, which is used to transport a sheet toward a straight path 12 (shown in the broken line in FIG. 1), which will be described below, and a driven roller 18*a*, which is used to nip and separate the sheet with the drive roller 18*b*.

The uppermost sheet of the sheets stored in the sheet storage cassette 7 is picked up by the feeding roller 17 and transported toward the downstream side. In some cases, the next and subsequent sheets can be transported together with the uppermost sheet; however, the uppermost sheet is separated from the next and subsequent sheets by the separation roller pair 18 and only the uppermost sheet is transported to the feeding path 14.

A registration roller pair 19 is provided on the downstream side of the separation roller pair 18 in the transport direction. In this embodiment, the feeding path 14 and the straight path 12 are connected with each other at the position of the registration roller pair 19. The straight path 12 is a substantially linearly extending path, and along which an upstream-side transport roller pair 20, the line head 10, and a downstream-side transport roller pair 21 are disposed on the downstream side of the registration roller pair 19. The straight path 12 includes a recording area K (FIG. 2) in which recording is performed by the line head 10.

The upstream-side transport roller pair 20 is an upstream-side transport section that is disposed on the upstream side of the line head 10 in the medium transport direction. The downstream-side transport roller pair 21 is a "downstream-side transport section" that is disposed on the downstream side of the line head 10 in the medium transport direction. A medium support section 22 is disposed in an area facing the head surface of the line head 10. The medium support section 22 supports a sheet from the opposite side of the recording surface.

A corrugating section 30, which will be described below, for forming corrugations in the sheet width direction (X-axis direction) is disposed on the upstream side of the line head 10 and on the upstream side of the upstream-side transport roller pair 20. A relaxing section 40, which is a feature of the disclosure, is disposed on the immediately downstream side of the downstream-side transport roller pair 21. The relaxing section 40 relaxes corrugations of a sheet formed by the corrugating section 30. Specific structures of the corrugating section 30 and the relaxing section 40 will be described in detail below.

The line head 10 ejects an ink (liquid) for recording onto a sheet that has been transported to the recording area K (FIG. 2), which faces the line head 10, on the medium support section 22. The line head 10 is a recording head that is provided such that nozzles for ejecting an ink covers the full width of the sheet to enable recording onto the entire medium width without movement in the medium width direction. Although the printer 1 according to the embodiment includes the line head 10, the printer 1 may include a serial recording head that is mounted on a carriage to eject liquid while reciprocating in a direction intersecting the medium transport direction.

In addition to the recording by feeding a sheet stored in the sheet storage cassette 7, to the printer 1, a sheet may be fed from a manual feed tray 5. In FIG. 1, the dotted line R shows a transport path for a sheet fed from the manual feed tray 5. The sheet fed from the manual feed tray 5 is transported by the transport roller pair 6 onto the straight path 12, and recording is performed by the line head 10 similarly to the sheet fed from the sheet storage cassette 7.

The sheet recorded by the line head 10 is transported to a first discharge path 13 or a second discharge path 24 from the straight path 12 depending on the discharge destination of the recorded sheet. The first discharge path 13 is a "curved path" that has a curve connected to the straight path 12 on the downstream side of the line head 10. A sheet is discharged from the first discharge section 8 with the recorded side of the sheet facing downward. The second discharge path 24 is a path that linearly extends from the straight path 12 on the downstream side of the line head 10. A sheet is discharged from the second discharge section 9 with the recorded side of the sheet facing upward. The first discharge path 13 and the second discharge path 24 branch from the straight path 12 on the downstream side of the downstream-side transport roller pair 21, and are referred to as a plurality of "post-recording transport paths" that have different transport destinations.

At a branch point S1 where the first discharge path 13 and the second discharge path 24 branch off from the straight path 12, a switching section 26 such as a guide flap for switching destinations of a recorded sheet is disposed. The switching section 26 is controlled by a controller 27. The controller 27 controls the sheet transportation operation in the printer 1, and also controls recording operation including the operation of the switching section 26.

A sheet that has been switched and transported from the straight path 12 to the first discharge path 13 by the switching section 26 is transported by a transport roller pair group 23 and discharged from the first discharge section 8 onto the first medium mounting section 3 with its recorded side facing downward. A sheet that has been transported from the straight path 12 to the second discharge path 24 is transported by a transport roller pair 25 and discharged from the second discharge section 9 onto the second medium mounting section 4 with its recorded side facing upward.

Next, transport paths for two-sided recording will be described. The printer 1 (FIG. 1) includes a switchback path 15 and a reversing path 16. The switchback path 15 branches off from the straight path 12 on the downstream side of the line head 10 and on the upstream side (in the embodiment, on the upstream side of the transport roller pair group 23 in FIG. 1) of the first discharge path 13. The reversing path 16 is connected to the switchback path 15 to reverse the front side and back side (the first side and the second side) of a sheet and return the sheet to the straight path 12. The switchback path 15 is also a "curved path" that has a curve. A guide flap 36 is disposed at a branch point S2 between the straight path 12 and the switchback path 15, and a guide flap 37 is disposed at a junction of the switchback path 15 and the reversing path 16. By switching the guide flap 36 and the guide flap 37, the path along which a sheet is to be transported can be switched. The operation of the guide flaps 36 and 37 is controlled by the controller 27.

To perform two-sided recording in the printer 1, a sheet after recording has been performed on its first side is transported to the switchback path 15 and then transported to the reversing path 16. The reversing path 16 is connected to the upstream side of the straight path 12, and the sheet that has been reversed through the reversing path 16 is transported to the straight path 12 with its second side facing the line head 10. Then, recording is performed onto the second side. The sheet after recording on its second side is switched by the switching section 26 and discharged from the first discharge section 8 through the first discharge path 13 or from the second discharge section 9 through the second discharge path 24. In this embodiment, the switchback path 15 to which a sheet after recording on its first side is transported is also an example "post-recording transport path".

Corrugating Section

With reference to FIG. 2 to FIG. 4, the corrugating section 30 will be described. The corrugating section 30 alternately forms crests T (shown by the alternate long and short dashed lines in FIG. 3) and troughs V (shown by the broken lines in FIG. 3) in a sheet P along the width direction (X-axis direction) which intersects the medium transport direction as illustrated in FIG. 3. Hereinafter, the forms of alternating crests T and troughs V in the medium transport direction (Y-axis direction) formed by the corrugating section 30 along the width direction (X-axis direction), which intersects the medium transport direction, are referred to as corrugations. As illustrated in FIG. 2, the corrugating section 30 includes ribs 31 that are disposed on the upstream side of the upstream-side transport roller pair 20 in the medium transport direction to support the sheet P from the second side and pressing sections 32 that are disposed above the ribs 31 to come into contact with the first side of the sheet P.

As illustrated in FIG. 3 and FIG. 4, the ribs 31 are disposed at predetermined intervals in the width direction (X-axis direction). The pressing sections 32 include a plurality of rollers 32*b* that are pivotally supported by a shaft section 32*a*, and the rollers 32*b* are disposed between the ribs 31 respectively. In other words, in the sheet width direction, the rollers 32*b* and the ribs 31 are alternately disposed.

The rollers 32*b* and the ribs 31 are disposed to partially overlap one another in the height direction (Z-axis direction) as illustrated in FIG. 2. As illustrated in FIG. 4, when the sheet P passes between the rollers 32*b* and the ribs 31, while the sheet P is supported by the ribs 31 from below, pressed from above by the rollers 32*b* between the ribs 31. Consequently, the crests T and the troughs V are alternately formed in the sheet P and thereby corrugations are formed. The corrugated sheet P becomes to have increased stiffness and becomes stable on the medium support section 22. Accordingly, high-quality recording can be achieved by the line head 10.

The corrugating section 30 according to the embodiment has the rollers 32*b* at the both ends in the width direction such that the corrugations in the sheet P has the troughs V at the end portions in the width direction. This structure prevents the end portions of the sheet P from facing the line head 10, and thus the risk of head rubbing of the sheet P can be reduced.

In this embodiment, the upstream-side transport roller pair 20 and the downstream-side transport roller pair 21 are disposed such that a plurality of rollers are disposed at predetermined intervals in the width direction (X-axis direction) which intersects the medium transport direction (FIG. 3). With this structure, the corrugations formed in the sheet P by the corrugating section 30 can be maintained more stably than with a structure in which, as the upstream-side transport roller pair 20 and the downstream-side transport roller pair 21, for example, rollers that are wide in the width direction are used. In this embodiment, the corrugating section 30 is disposed on the upstream side of the upstream-side transport roller pair 20 in the transport direction. Alternatively, the corrugating section 30 may be disposed between the line head 10 and the upstream-side transport roller pair 20. Furthermore, in this embodiment, in the corrugating section 30, the members for supporting the sheet P from the second side are the ribs 31 and the pressing sections 32 for pressing the sheet P from the first side are the rollers. Alternatively, the pressing sections 32 may be ribs and the ribs may be disposed above and below the sheet P. Alternatively, the members for supporting the sheet P from the second side may be rollers and the rollers may be disposed above and below the sheet P.

Relaxing Section

With reference to FIG. 2, FIG. 3, and FIG. 5, the relaxing section 40 will be described. The relaxing section 40 is disposed between the line head 10 and the branch point S1 from which the first discharge path 13 and the second discharge path 24 branch off from the straight path 12 as illustrated in FIG. 2. In this embodiment, the branch point S2, from which the switchback path 15 branches off from the straight path 12, is also provided on the upstream side of the branch point S1, and accordingly, the relaxing section 40 is disposed between the branch point S2 and the line head 10. More specifically, the relaxing section 40 is disposed on the immediately downstream side of the downstream-side transport roller pair 21.

The relaxing section 40 can be switched between a position (the lower diagram in FIG. 5) for relaxing the corrugations that have been formed by the corrugating section 30 in the sheet P and a position (the upper diagram in FIG. 5) for maintaining the corrugations. The switching between the relaxing position and the maintaining position of the relaxing section 40 is performed by the controller 27 (FIG. 1).

The controller 27 switches the relaxing section 40 depending on to which "post-recording transport path" the recorded sheet P is to be transported, that is, to which one of the first discharge path 13, the second discharge path 24, and the switchback path 15, the sheet P is to be transported. This is a feature of the disclosure. In the description below, a specific structure of the relaxing section 40 will be described first and then the switching between the relaxing position (the lower diagram in FIG. 5) and the maintaining position (the upper diagram in FIG. 5) by the controller 27 will be described.

Structure of Relaxing Section

The relaxing section 40 (FIG. 3 and FIG. 5) includes a plurality of relaxing-section drive rollers 41 that are disposed at predetermined intervals in the width direction (X-axis direction) and a plurality of relaxing-section driven rollers 42 that are disposed to correspond to the relaxing-section drive rollers 41 to come into contact with the relaxing-section drive rollers 41 to be driven. The relaxing-section drive rollers 41 are pivotally supported by a rotation shaft 43 (FIG. 5) and driven by a drive source (not illustrated). The relaxing-section driven rollers 42 are pivotally supported by individual rotation shafts 44 respectively.

As described above, the relaxing section 40 can be switched between the relaxing position and the maintaining position. In the relaxing position, as illustrated in the lower diagram in FIG. 5, among the relaxing-section driven rollers 42, a relaxing-section driven roller 42*a* at a central section in the width direction is brought into contact with the relaxing-section drive roller 41, and the relaxing-section driven rollers at end portion sides in the width direction are separated from the relaxing-section drive rollers 41. On the other hand, in the maintaining position, as illustrated in the upper diagram in FIG. 5, the relaxing-section driven rollers 42 are brought into contact with the relaxing-section drive rollers 41.

That is, the controller 27 that switches the relaxing section 40 between the relaxing position and the maintaining position switches the relaxing section 40 to the maintaining position by bringing the relaxing-section driven rollers 42 to come into contact with the relaxing-section drive rollers 41 (the upper drawing in FIG. 5) to maintain the corrugations, whereas the controller 27 switches the relaxing section 40 to the relaxing position by bringing the relaxing-section driven roller 42*a* at the central section in the width direction among the relaxing-section driven rollers 42 to come into contact with the relaxing-section drive roller 41 and separating the relaxing-section driven rollers 42*b* on the end portion sides in the width direction from the relaxing-section drive rollers (the lower drawing in FIG. 5) to relax the corrugations.

In the maintaining position (the upper drawing in FIG. 5) of the relaxing section 40, the sheet P is nipped by all relaxing-section drive rollers 41 and the relaxing-section driven rollers 42. In this embodiment, the relaxing-section drive rollers 41 in the maintaining position of the relaxing section 40 are disposed at positions corresponding to the ribs 31, which constitute the corrugating section 30. In other words, the relaxing-section drive rollers 41 are disposed at positions corresponding to the crests T of the corrugations formed in the sheet P by the corrugating section 30 in the maintaining position of the relaxing section 40. That is, the relaxing-section drive rollers 41 and the relaxing-section driven rollers 42 are disposed to nip the portions of the crests T of the sheet P. With this structure, the troughs V of the sheet P pass through the nip portions by the relaxing-section drive rollers 41 and the relaxing-section driven rollers 42. Accordingly, in the maintaining position of the relaxing section 40, the sheet P can be transported in a state the crests T and the troughs V are maintained stably.

In the relaxing position (the lower drawing in FIG. 5) of the relaxing section 40, the sheet P is nipped only by the relaxing-section driven roller 42*a* at the central section in the sheet width direction and the relaxing-section drive rollers 41 and the other relaxing-section driven rollers 42*b* at the end portion sides in the width direction are separated from the relaxing-section drive rollers 41 such that the corrugations in the sheet P can be released to the outside (in the directions of the outline arrows in the lower drawing in FIG. 5) in the width direction. That is, the sheet P can move to relax the corrugations that have been formed by the corrugating section 30 in the sheet P. The corrugations of the sheet P can be relaxed by the restoring force to return to the state no corrugations are formed in the sheet P.

Control of Relaxing Section by Controller

The control of switching the relaxing section 40 by the controller 27 will be described. As described above, the controller 27 switches the relaxing section 40 depending on to which one of the first discharge path 13, the second discharge path 24, and the switchback path 15 (see FIG. 1 and FIG. 2) the recorded sheet P is to be transported. Specifically, the controller 27 switches the relaxing section 40 to the relaxing position when the "post-recording transport path" to which the recorded sheet is to be transported includes a curved path for curving and transporting the sheet P. In this embodiment, the first discharge path 13 and the switchback path 15 are the paths that include curved paths (FIG. 1 and FIG. 2).

In other words, the controller 27 sets the relaxing section 40 to the relaxing position (the lower drawing in FIG. 5) when the sheet P is to be transported to the first discharge path 13 or the switchback path 15. When the sheet P is transported in the first discharge path 13 or the switchback path 15, the corrugated sheet P can be caught in the paths and a paper jam may occur. Accordingly, when the recorded sheet P is transported to the first discharge path 13 or the switchback path 15 that include the curved paths, the relaxing section 40 is set to the relaxing position to relax the corrugations of the sheet P and thereby a jam due to the corrugations of the sheet P in the curved path can be prevented.

To transport the sheet P to the second discharge path 24, the relaxing section 40 is set to the maintaining position (the upper drawing in FIG. 5). The corrugated sheet P can be discharged onto the discharge tray (the second medium mounting section 4) in a well-aligned state. Accordingly, when the sheet P is transported to the second discharge path 24 that is substantially linear and unlikely to cause a jam due to the corrugations of the sheet P, the relaxing section 40 is set to the maintaining position to allow the sheet P to be discharged from the second discharge section 9 with the corrugations of the sheet P maintained. With this structure, the sheet P can be stacked onto the second medium mounting section 4 in a well-aligned state.

As described above, with the relaxing section 40 disposed between the line head 10 and the branch point S1 and the branch point S2 of the "post-recording transport paths" and the switching of the relaxing section 40 depending on the transport destination of the recorded sheet by the controller 27, the following operational advantages can be achieved. For the plurality of "post-recording transport paths" (the first discharge path 13, the switchback path 15, and the second discharge path 24), the only one relaxing section 40 is enough and thus with the simple structure, the sheet P can be readily corrugated to correspond to the shape of each "post-recording transport path" or the transport destination.

Example Modification of Relaxing Section According to First Embodiment

The relaxing section 40 in FIG. 2 can also serve as the downstream-side transport roller pair 21. A relaxing section 40A illustrated in FIG. 6 is an example "relaxing section" that also serves as the downstream-side transport roller pair 21 (downstream-side transport section) in FIG. 2. The relaxing section 40A has a structure similar to that of the relaxing section 40 (FIG. 2 and FIG. 5), and when the relaxing section 40A functions as the "the downstream-side transport section (the downstream-side transport roller pair 21 in FIG. 2)", the relaxing section 40A is set to the maintaining position. Specifically, all relaxing-section driven rollers 42 (42*a* and 42*b*) come into contact with the relaxing-section drive rollers 41. The relaxing section 40A that serves as the "relaxing section" and the "downstream-side transport section" can reduce the number of components, and thereby cost reduction and space saving can be achieved.

When the relaxing section 40A that serves as the "relaxing section" and the "downstream-side transport section" is provided, the switching of the relaxing section 40A from the maintaining position to the relaxing position by the controller 27 is performed after the recording onto the sheet P by the line head 10 has completed.

If the relaxing section 40A (FIG. 6) is switched from the maintaining position to the relaxing position during the recording onto the sheet P, the shape of the corrugations of the sheet P in the recording area K may be changed and this may affect the quality in recording to the sheet P. By performing the switching of the relaxing section 40A from the maintaining position to the relaxing position by the controller 27 after the completion of the recording, however, the effect on the quality in recording due to the switching of the relaxing section 40A, which also serves as the "downstream-side transport section", to the relaxing position can be reduced.

Second Embodiment

Figure 7:
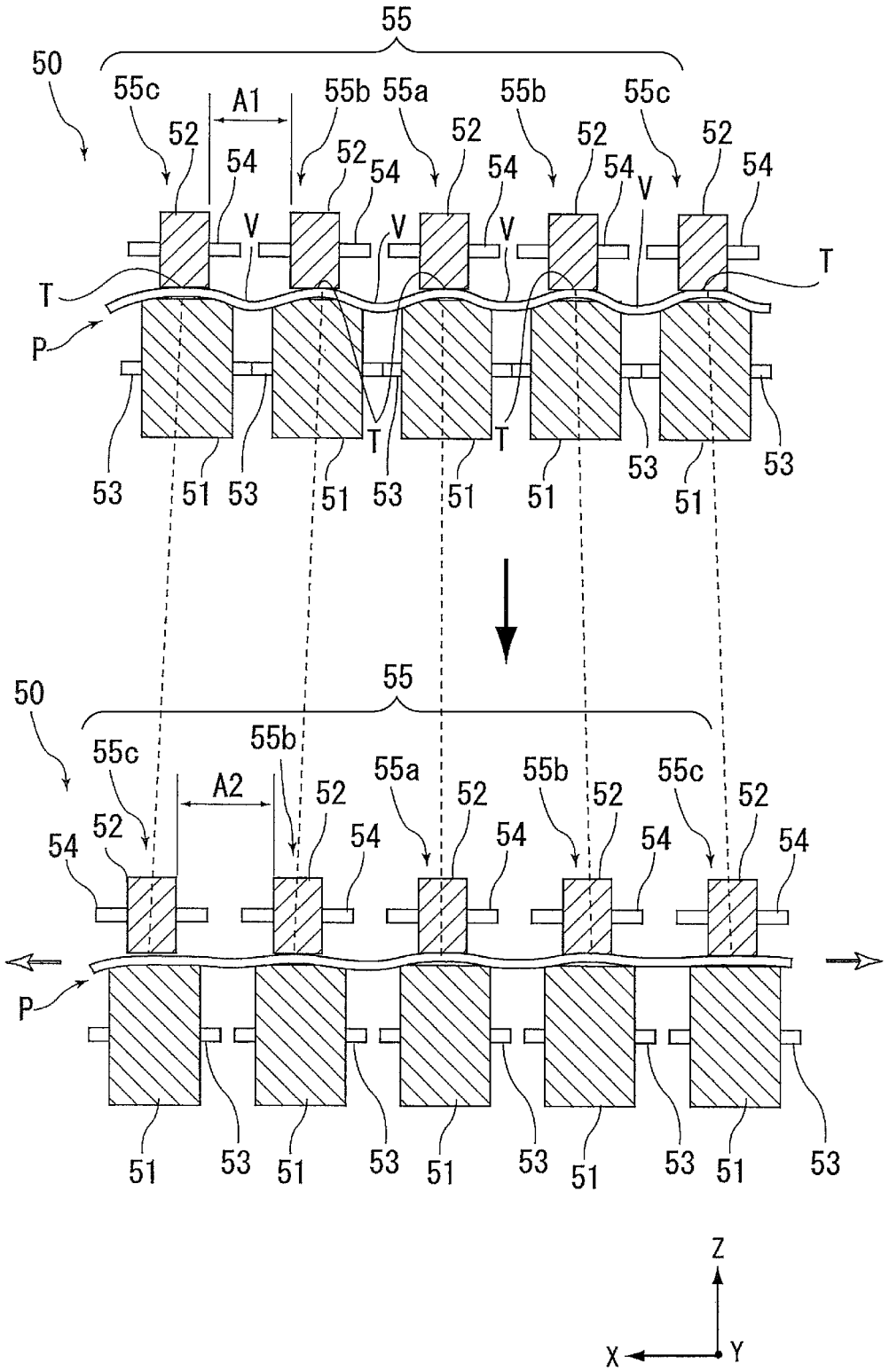
FIG. 7 is a cross-sectional view of a ZX plane of a relaxing section according to a second embodiment.

A "relaxing section" according to a second embodiment will be described with reference to FIG. 7. FIG. 7 is a cross-sectional view of a ZX plane of the relaxing section according to the second embodiment. In the embodiments including this embodiment described below, the same reference numerals are given to components similar to those in the first embodiment, and their descriptions will be omitted.

A relaxing section 50 (FIG. 7) according to the second embodiment includes a plurality of relaxing-section roller pairs 55 that have relaxing-section drive rollers 51 and relaxing-section driven rollers 52 that come into contact with the relaxing-section drive rollers 51 to be driven and rotated at predetermined intervals in the width direction (X-axis direction). In this embodiment, the relaxing-section drive rollers 51 are pivotally supported by individual rotation shafts 53 respectively. The relaxing-section driven rollers 52 are similarly pivotally supported by individual rotation shafts 54 respectively.

Furthermore, in the relaxing section 50, the interval between the relaxing-section roller pairs 55 can be changed. The upper drawing in FIG. 7 illustrates the maintaining position of the relaxing section 50 and the lower drawing in FIG. 7 illustrates the relaxing position. The interval between the relaxing-section roller pairs 55 in the maintaining position of the relaxing section 50 is A1, and the interval can be widened to a wider interval A2. The changing of the intervals of the relaxing-section roller pairs 55 is performed by the controller 27. To switch the relaxing section 50 from the maintaining position (the upper drawing in FIG. 7) to the relaxing position (the lower drawing in FIG. 7), the controller 27 controls to widen the intervals between the relaxing-section roller pairs 55 that are nipping the sheet P from A1 to A2.

A relaxing-section roller pair 55*a* at a central section is fixed, and relaxing-section roller pairs 55*b* on both sides of the relaxing-section roller pair 55*a* and relaxing-section roller pairs 55*c* on further outer sides of the relaxing-section roller pairs 55*b* are moved to the outside (in the directions of the outline arrows in the lower drawing in FIG. 7) in the width direction to widen the intervals of the relaxing-section roller pairs 55.

In this embodiment, the relaxing-section drive rollers 51 of the relaxing section 50 in the maintaining position (the upper drawing in FIG. 7) are disposed at positions corresponding to the crests T of the corrugations formed in the sheet P by the corrugating section 30 (FIG. 3). That is, the relaxing-section roller pairs 55 are disposed to nip the crests T of the sheet P.

If the relaxing section 50 is switched from the maintaining position (the upper drawing in FIG. 7) to the relaxing position (the lower drawing in FIG. 7) while the crests T of the sheet P are nipped by the relaxing-section roller pairs 55, the troughs V of the sheet P are released in the width direction and thereby the corrugations of the sheet P can be relaxed.

Similarly to the modification of the first embodiment, the relaxing section 50 may also serve as the downstream-side transport roller pair 21 (FIG. 2). In such a case, it is preferable that the switching of the relaxing section 50 that also serves as the downstream-side transport roller pair 21 from the maintaining position to the relaxing position be performed after the recording onto the sheet P by the line head 10 has completed.

Third Embodiment

Figure 8:
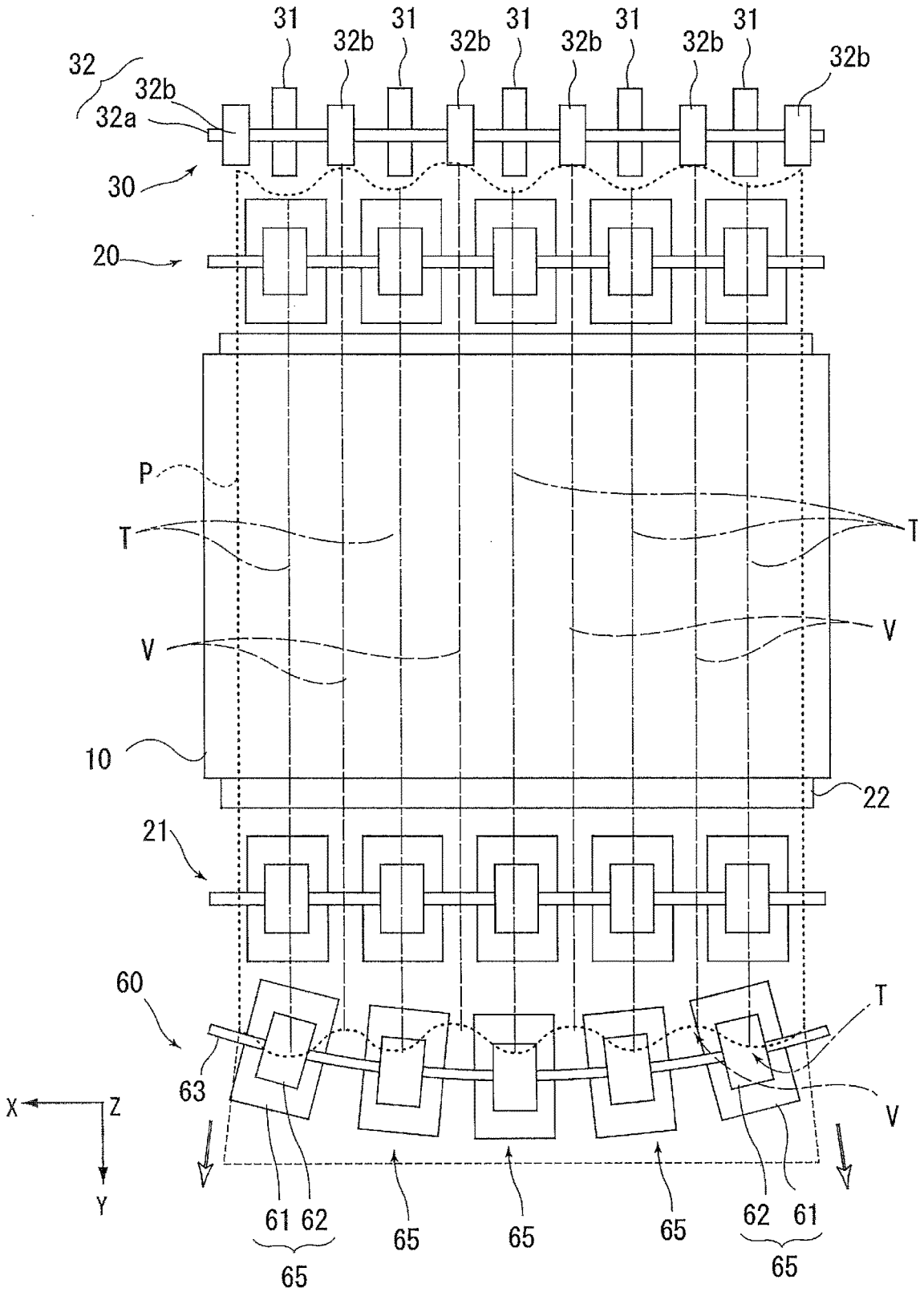
FIG. 8 is a schematic plan view of a relaxing section according to a third embodiment, a recording section, and peripheral elements.

A "relaxing section" according to a third embodiment will be described mainly with reference to FIG. 8. FIG. 8 is a schematic plan view of components around a recording section including a relaxing section according to the third embodiment. A relaxing section 60 (FIG. 8) according to the third embodiment includes a plurality of relaxing-section roller pairs 65 that have relaxing-section drive rollers 61 and relaxing-section driven rollers 62 that come into contact with the relaxing-section drive rollers 61 to be driven and rotated at predetermined intervals in the width direction (X-axis direction). The relaxing-section roller pairs 65 are disposed such that as the relaxing-section roller pairs 65 are closer to the end portion sides in the width direction, the rotation shaft is inclined outward in the width direction as illustrated in FIG. 8. In this embodiment, the relaxing-section driven rollers 62 are pivotally supported by a rotation shaft 63 that is curved in a concave-upward shape in FIG. 8. Similarly, the relaxing-section drive rollers 61 are pivotally supported by a curved rotation shaft although the shaft is overlapped with the rotation shaft 63 and not shown in FIG. 8.

The relaxing-section driven rollers 62 can be set to a position to come into contact with the relaxing-section drive rollers 61 or a position separated from the relaxing-section drive rollers 61. The controller 27 (FIG. 1) that switches the relaxing section 60 between the relaxing position and the maintaining position switches the relaxing section 60 to the maintaining position by separating the relaxing-section driven rollers 62 from the relaxing-section drive rollers 61, and switches the relaxing section 60 to the relaxing position by bringing the relaxing-section driven rollers 62 into contact with the relaxing-section drive rollers 61. FIG. 8 illustrates the relaxing-section driven rollers 62 and the relaxing-section drive rollers 61 that are in contact with each other, that is, the relaxing section 60 that is set to the relaxing position.

The closer the relaxing-section roller pairs 65 in the relaxing section 60 to the end portion sides in the width direction, the further the rotation shaft is inclined outward in the width direction, and thus the sheet P is transported so as to be stretched outward in the width direction (in the directions of the outline arrows in FIG. 8) when the relaxing section 60 is set to the relaxing position in which the relaxing-section driven rollers 62 are brought into contact with the relaxing-section drive rollers 61. Accordingly, the corrugations formed in the sheet P can be relaxed. To set the relaxing section 60 to the maintaining position, the relaxing-section driven rollers 62 are separated from the relaxing-section drive rollers 61 so that the sheet P is not relaxed and the corrugations can be maintained.

Example Modification of Relaxing Section According to Third Embodiment

Figure 9:
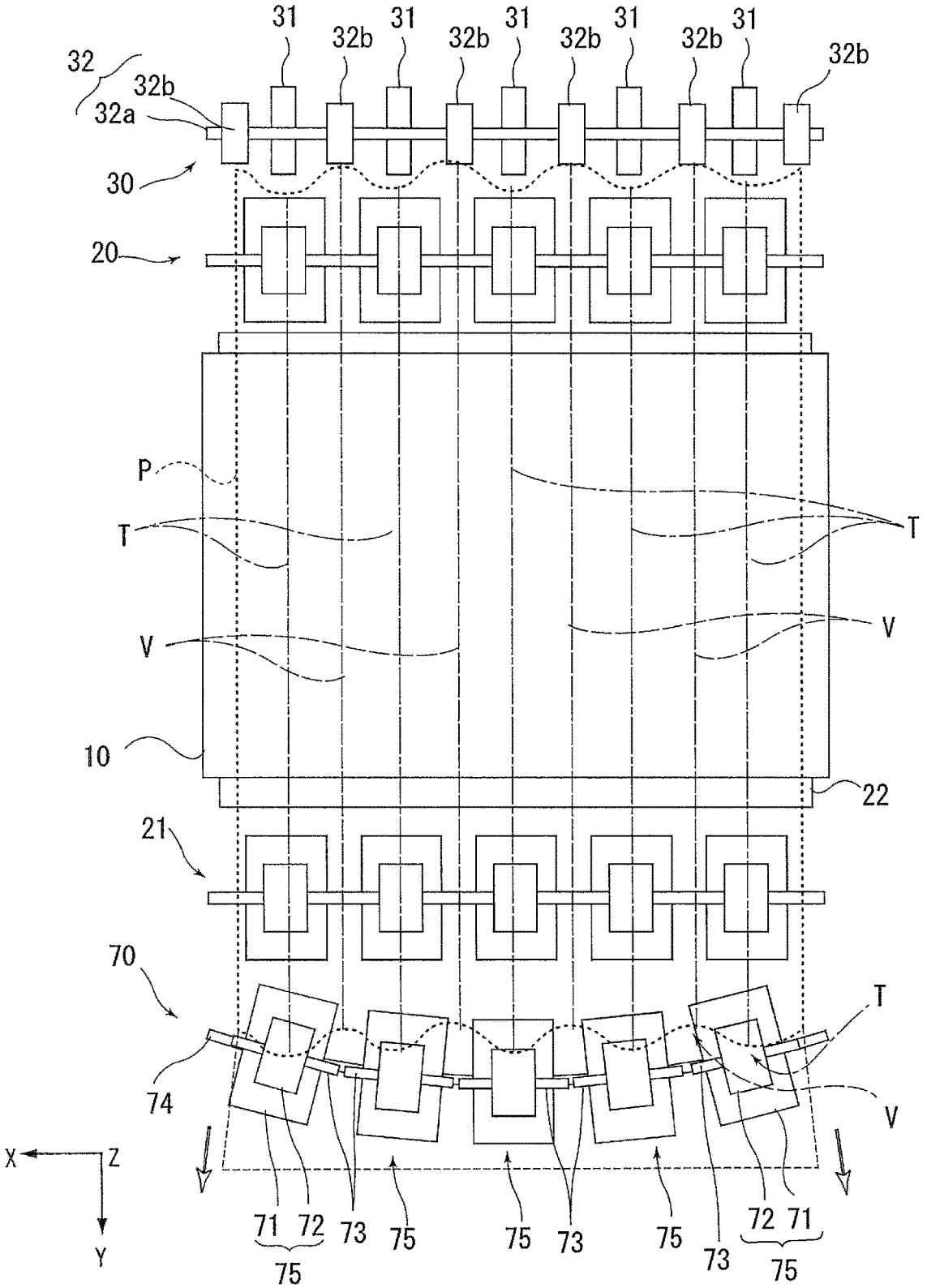
FIG. 9 is a modification of the relaxing section according to the third embodiment.

Instead of the relaxing section 60 in FIG. 8, a relaxing section 70 illustrated in FIG. 9 may be provided. FIG. 9 is a modification of the relaxing section according to the third embodiment. In the relaxing section 70 in FIG. 9, a plurality of relaxing-section driven rollers 72 are pivotally supported by individual rotation shafts 73 respectively. A plurality of relaxing-section drive rollers 71 are pivotally supported by a single curved rotation shaft 74. The relaxing-section driven rollers 72 that are pivotally supported by individual rotation shafts 73 enable each relaxing-section roller pair 75 to change the distance for separating the relaxing-section driven roller 72 from the relaxing-section drive roller 71 when the relaxing section 70 is set to the maintaining position. For example, the relaxing-section driven rollers 72 closer to the end portion sides than a central section in the width direction can be widely separated. Accordingly, the corrugations in the sheet P can be readily relaxed to the end portion sides in the width direction. It should be noted that the relaxing-section drive rollers 71 may also be supported by individual rotation shafts.

Fourth Embodiment

Figure 10:
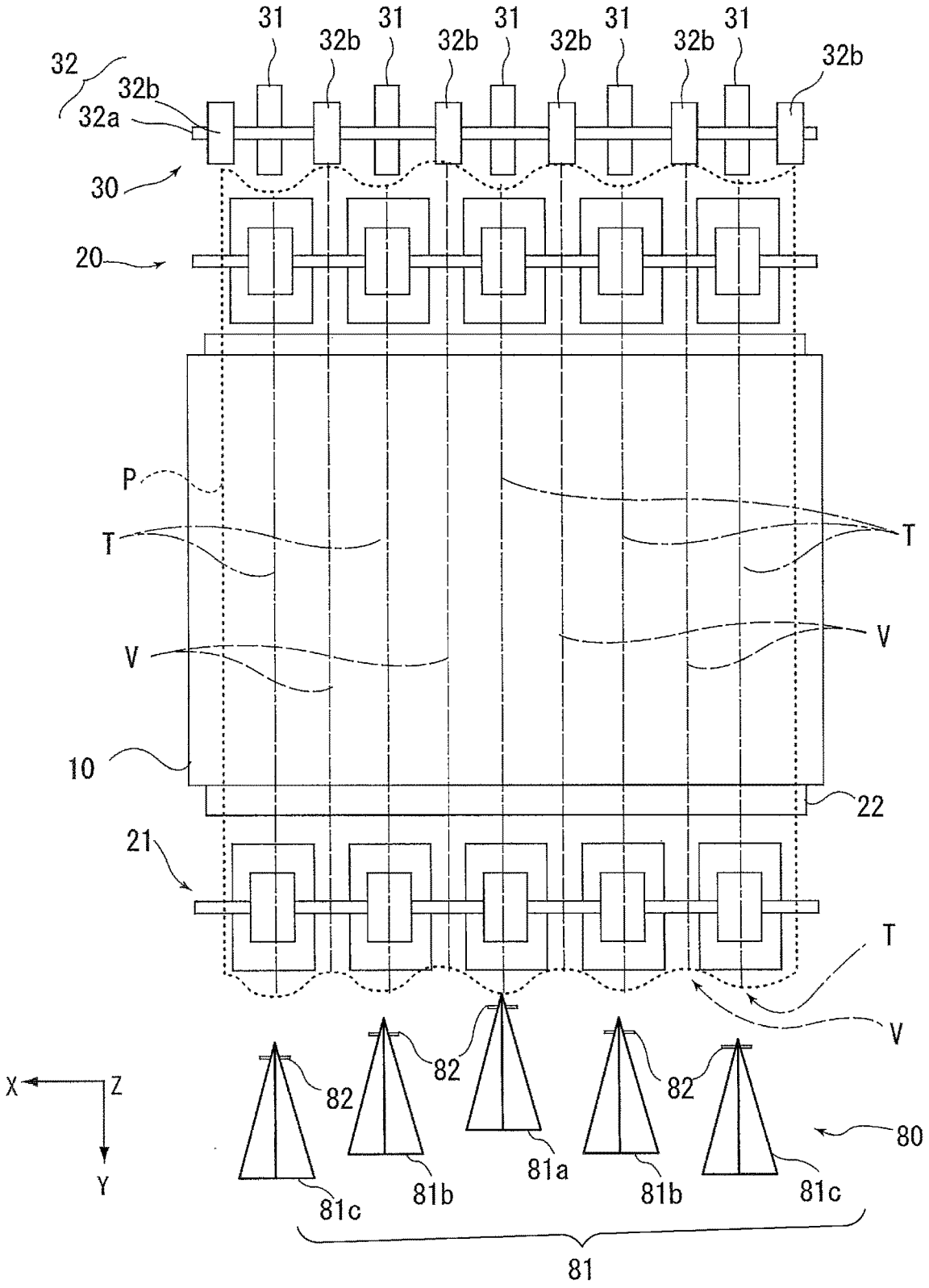
FIG. 10 is a schematic plan view of a relaxing section according to a fourth embodiment, a recording section, and peripheral elements.
Figure 11:
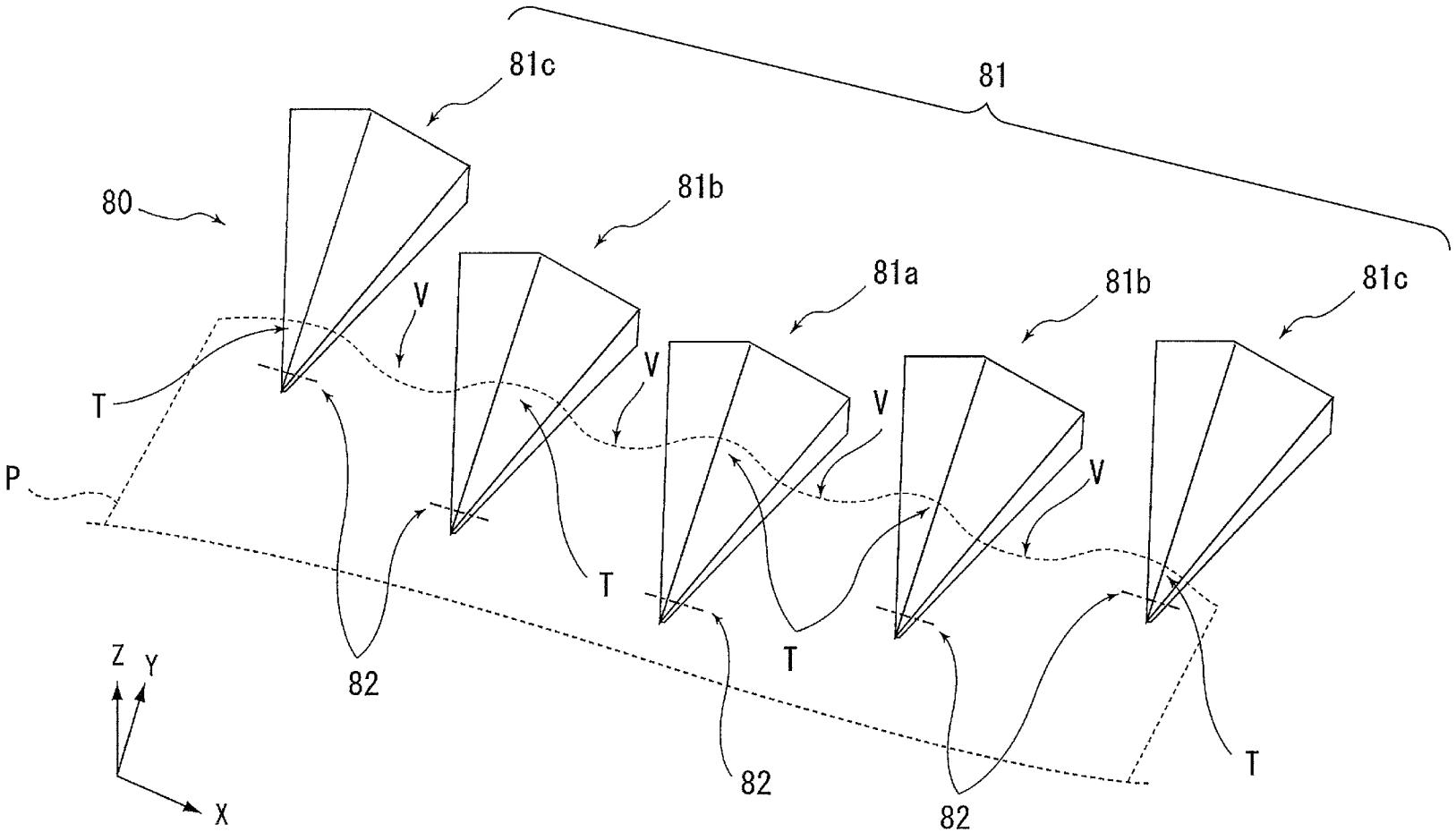
FIG. 11 is a perspective view of the relaxing section according to the fourth embodiment.
Figure 12:
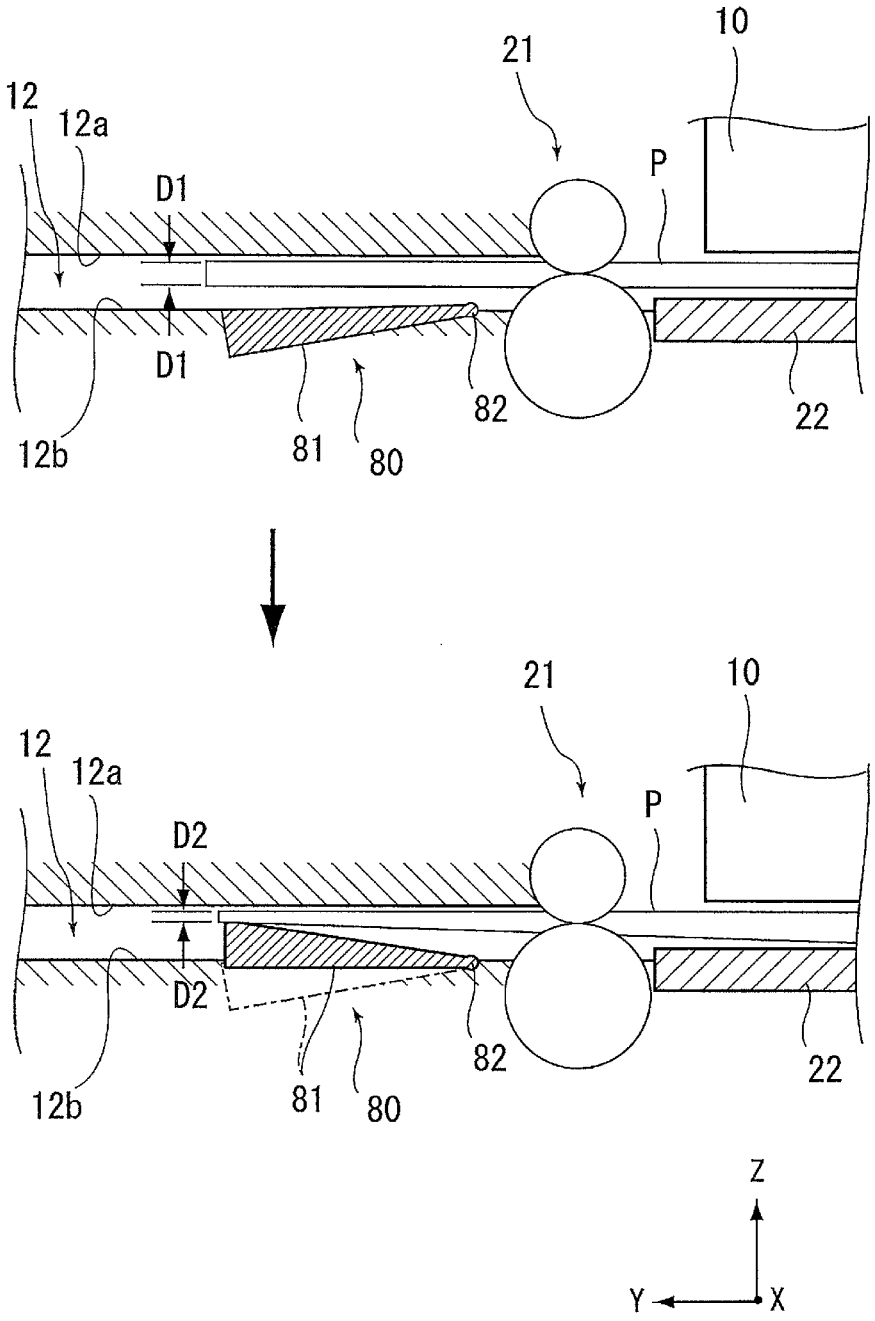
FIG. 12 is a cross-sectional view of a YZ plane of the relaxing section according to the fourth embodiment.

A "relaxing section" according to a fourth embodiment will be described mainly with reference to FIG. 10 to FIG. 12. FIG. 10 is a schematic plan view of components around a recording section including a relaxing section according to the fourth embodiment. FIG. 11 is a perspective view the relaxing section according to the fourth embodiment. FIG. 12 is a cross-sectional view of a YZ plane of the relaxing section according to the fourth embodiment.

As illustrated in FIG. 12, in the relaxing position, a relaxing section 80 according to the fourth embodiment protrudes from the straight path 12 (transport path) to come into contact with the sheet P (the lower drawing in FIG. 12) from the opposite side (from below in FIG. 12) of the recording side of the sheet P, and in the maintaining position, the relaxing section 80 retracts from the straight path 12 (the upper drawing in FIG. 12). A specific structure of the relaxing section 80 will be described.

In this embodiment, the relaxing section 80 (FIG. 12) is a swing member 81 that includes a pivot shaft 82 on the upstream side in the medium transport direction. As illustrated in FIG. 11, the swing member 81 extends from the pivot shaft 82 side toward the downstream side in the medium transport direction in the width direction and a central section in the width direction becomes higher toward the downstream side in the medium transport direction. In FIG. 11, the swing member 81 has the mountain shape that has the vertex at the central section in the width direction; however, the swing member 81 may have a smooth mountain shape without a vertex. As illustrated in FIG. 10, the relaxing section 80 includes a plurality of swing members 81 at positions corresponding to the crests T of the corrugations in the sheet P at predetermined intervals. With this structure, when the relaxing section 80 is set to the relaxing position (the lower drawing in FIG. 12), the corrugations in the medium can be further effectively relaxed.

In FIG. 12, an upper side surface of the straight path 12 is referred to as an upper-side path forming side 12*a* and a lower side surface is referred to as a lower-side path forming side 12*b*. When the relaxing section 80 is in the maintaining position (the upper drawing in FIG. 12), the sheet P is transported in the straight path 12 from which no swing member 81 protrudes, that is, the wide path, and thus the sheet P is transported while the corrugations in the sheet P are maintained (for example, in the upper drawing in FIG. 12, the width from the crest T to the trough V is D1). On the other hand, when the relaxing section 80 is in the relaxing position (the lower drawing in FIG. 12), the swing members 81 protrude from straight path 12 from below to come into contact with the sheet P. The corrugated sheet P is transported between the upper-side path forming side 12*a* and the swing members 81, that is, in the path that has been narrowed in the height direction. By transporting the sheet P in the path that has been narrowed in the height direction, the width between the crest T to the trough V becomes a depth D2 that is narrower than the depth D1. Accordingly, the corrugations in the sheet P can be relaxed. Since the switching between the maintaining position and the relaxing position can be performed by simply swinging the swing members 81, the relaxing section 80 can be provided in the simple structure.

It is preferable that among the swing members 81 in the relaxing section 80, the swing members 81 that are close to the central section in the width direction be disposed on the upstream side in the medium transport direction and the swing members 81 close to the end portion sides in the width direction be disposed on the downstream side in the medium transport direction. In this embodiment having the five swing members 81, the central swing member 81*a* is disposed on the most upstream side, the swing members 81*b* on both sides of the central swing member 81*a* are disposed on the downstream side of the swing member 81*a*, and the swing members 81*c* on further outer sides (end portion sides) of the swing members 81*b* are disposed on the further downstream side. The plurality of swing members 81 disposed in such an arrangement enable the sheet P to relax the corrugations from the central section toward the end portion sides and thus the structure is more effective. It should be noted that the plurality of swing members 81 (81*a*, 81*b*, 81*b*, 81*c*, and 81*c*) may be arranged at the same positions in the medium transport direction.

Example Modification of Relaxing Section According to Fourth Embodiment

Figure 13:
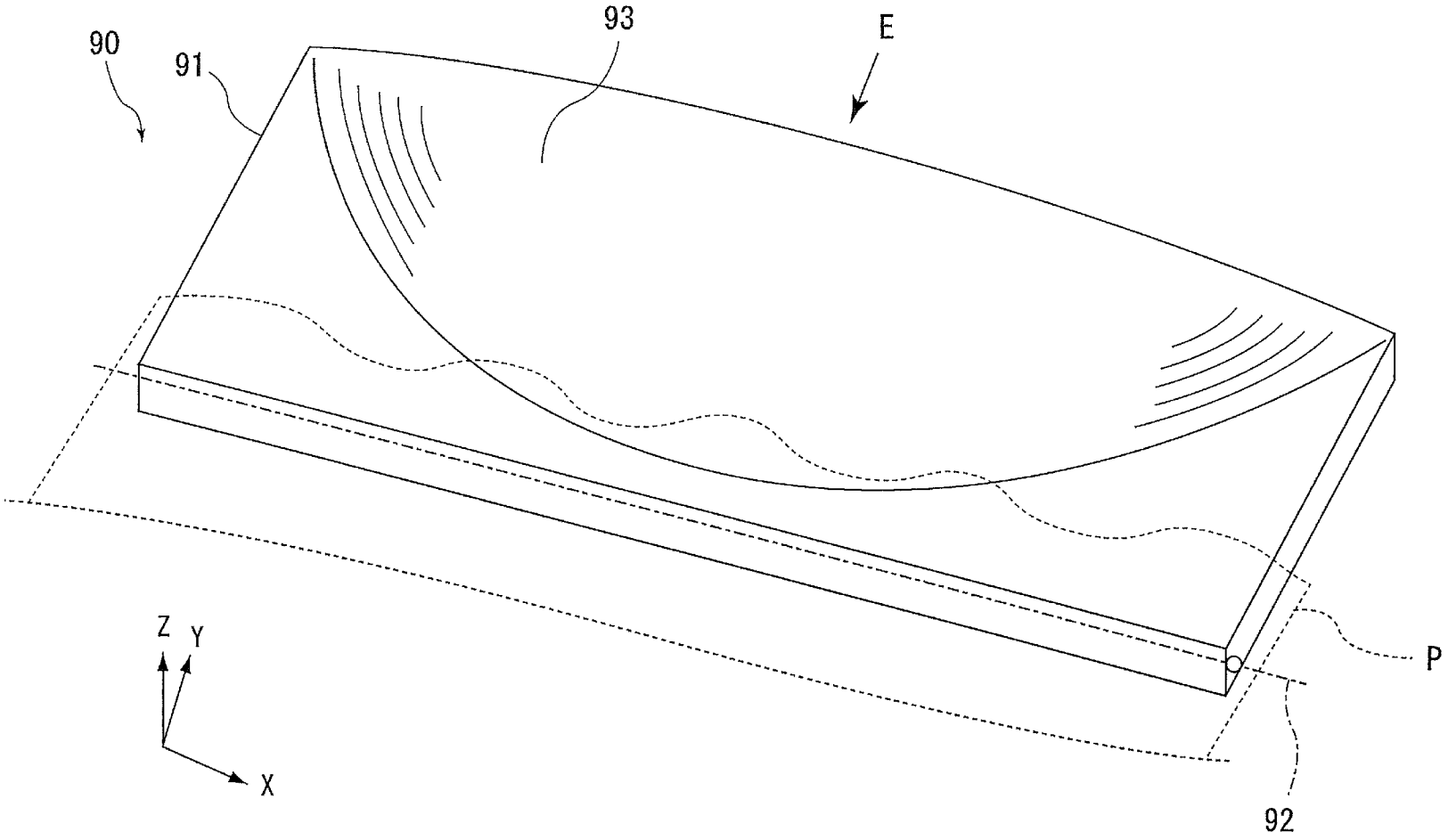
FIG. 13 is a perspective view of a modification of the relaxing section according to the fourth embodiment.
Figure 14:
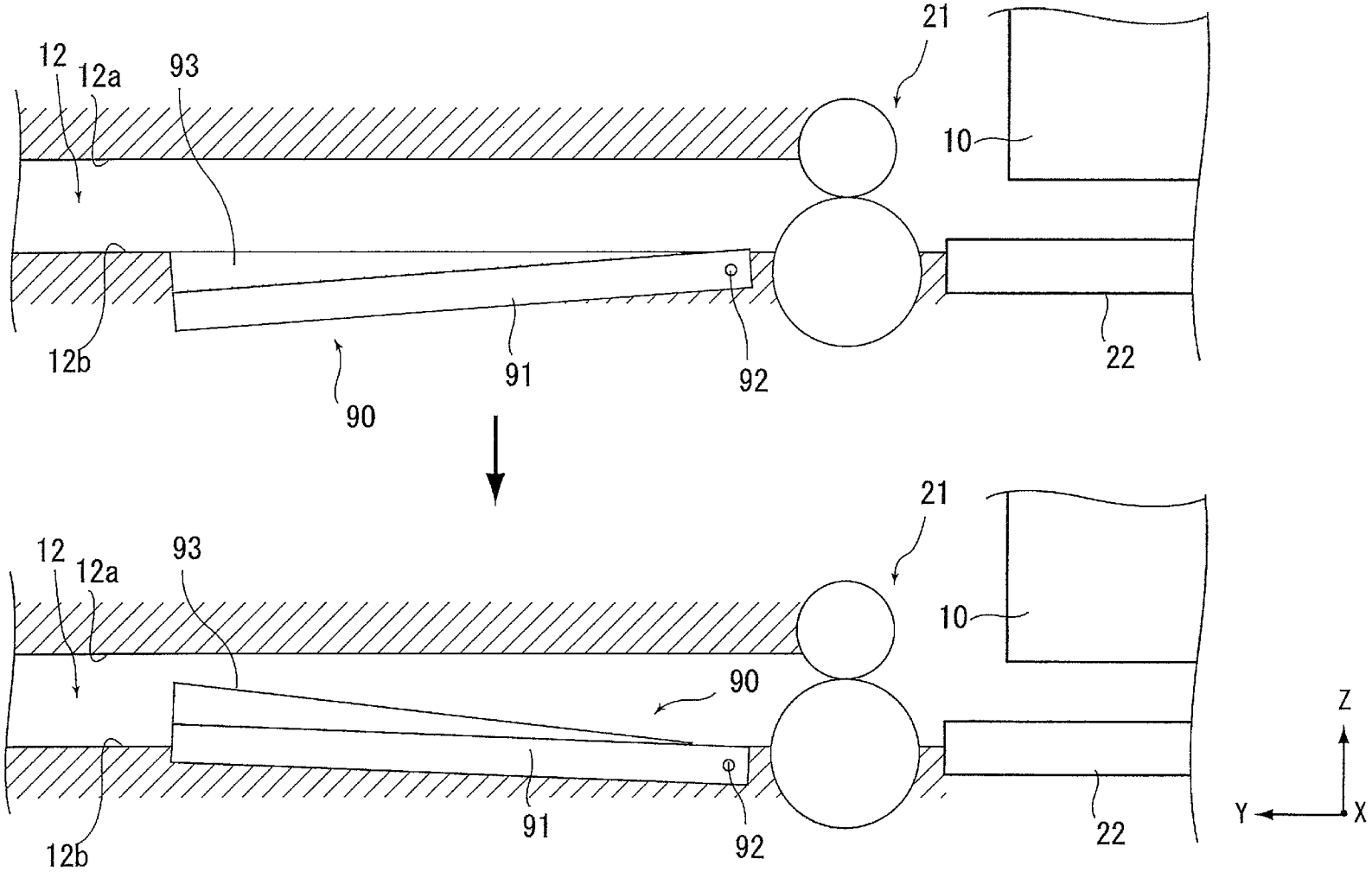
FIG. 14 is a cross-sectional view of a YZ plane of the modification of the relaxing section according to the fourth embodiment.

The relaxing section 80 in FIG. 10 includes the small swing members 81 arranged in the width direction. Alternatively, the swing members may be provided as a single member (FIG. 13 and FIG. 14). FIG. 13 is a perspective view illustrating a modification of the relaxing section according to the fourth embodiment. FIG. 14 is a cross-sectional view of a YZ plane of the relaxing section according to the modification of the fourth embodiment. The relaxing section 90 illustrated in FIG. 13 and FIG. 14 includes a swing member 91 that has a pivot shaft 92 on the upstream side in the medium transport direction. The swing member 91 can be set to a maintaining position (the upper drawing in FIG. 14) in which the swing member 91 is retracted from the straight path 12 or a relaxing position (the lower drawing in FIG. 14) in which the swing member 91 protrude from the straight path 12. The swing member 91 (FIG. 13) has a substantially rectangular shape from above in plan view and, on its upper surface side, has a mountain shaped section 93 that extends from the pivot shaft 92 side toward the downstream side in the medium transport direction in the width direction and a central section in the width direction becomes higher toward the downstream side in the medium transport direction.

The mountain shaped section 93 has an arched shape (including a semicircular shape) such as a shape formed by cutting out a part of a circular shape or an elliptical shape in plan view from above, and becomes higher toward the central section (the portion indicated by reference numeral E in FIG. 13) of the chord of the arched shape. With the single plate-shaped swing member 91 that has the mountain shaped section 93, when the swing member 91 is set to the relaxing position (the lower drawing in FIG. 14), the sheet P comes into contact with the mountain shaped section 93 from the central section and the corrugations are relaxed from the central section toward the end portion sides, and thereby the effect of relaxing the corrugations can be achieved.

It is to be understood that the present disclosure is not limited to the above-described embodiments, various modifications can be made within the scope of the following claims, and these modifications are also included within the scope of the disclosure.

What is claimed is:

1. A recording apparatus comprising:

a recording section configured to discharge a liquid onto a transported medium for recording;

a corrugating section disposed on an upstream side of the recording section in a medium transport direction, the corrugating section being configured to form crests and troughs in the medium, wherein the crests and troughs are formed so as to alternate in a width direction which intersects the medium transport direction;

a plurality of post-recording transport paths disposed on a downstream side of the recording section, the post-recording transport paths having different destinations for the recorded medium;

a relaxing section that can be switched between a relaxing position in which the corrugations formed by the corrugating section are relaxed and a maintaining position in which the corrugations are maintained with respect to the medium between the recording section and branch points of the post-recording transport paths in the medium transport direction; and a controller configured to control the switching of the relaxing section between the relaxing position and the maintaining position, wherein the controller switches the relaxing section depending on to which one of the post-recording transport paths the recorded medium is to be transported.

2. The recording apparatus according to claim 1, wherein the controller sets the relaxing section to the relaxing position when the post-recording transport path to which the recorded medium is to be transported includes a curved path for curving and transporting the medium.

3. The recording apparatus according to claim 1, wherein the relaxing section includes a plurality of relaxing-section drive rollers that are disposed at predetermined intervals in the width direction and a plurality of relaxing-section driven rollers that are disposed to correspond to the relaxing-section drive rollers to come into contact with the relaxing-section drive rollers to be driven, the controller brings the relaxing-section driven rollers into contact with the relaxing-section drive rollers to set the relaxing section to the maintaining position, and brings the relaxing-section driven roller at a central section among the relaxing-section driven rollers in the width direction into contact with the relaxing-section drive roller and separates the relaxing-section driven rollers at end portion sides in the width direction from the relaxing-section drive rollers to set the relaxing section to the relaxing position.

4. The recording apparatus according to claim 3, further comprising:

a downstream-side transport section disposed on the downstream side of the recording section in the medium transport direction, wherein the relaxing-section drive rollers and the relaxing-section driven rollers in the relaxing section also serve as the downstream-side transport section.

5. The recording apparatus according to claim 4, wherein the switching of the relaxing section from the maintaining position to the relaxing position by the controller is performed after the recording onto the medium by the recording section has completed.

6. The recording apparatus according to claim 3, wherein the relaxing-section drive rollers are disposed at positions corresponding to the crests of the corrugations formed in the medium by the corrugating section when the relaxing section is in the maintaining position.

7. The recording apparatus according to claim 1, wherein the relaxing section includes a plurality of relaxing-section roller pairs that have the relaxing-section drive rollers and the relaxing-section driven rollers that come into contact with the relaxing-section drive rollers to be driven and rotated at predetermined intervals in the width direction such that the predetermined intervals can be changed, and the controller performs control to widen the predetermined intervals of the relaxing-section roller pairs that are nipping the medium to switch the relaxing section from the maintaining position to the relaxing position.

8. The recording apparatus according to claim 1, wherein the relaxing section includes a plurality of relaxing-section roller pairs that have the relaxing-section drive rollers and the relaxing-section driven rollers that come into contact with the relaxing-section drive rollers to be driven and rotated at predetermined intervals in the width direction, a rotation shaft of the relaxing-section roller pairs is inclined such that as the relaxing-section roller pairs are closer to the end portion sides in the width direction, the medium is transported outward in the width direction, and the controller separates the relaxing-section driven rollers from the relaxing-section drive rollers to set the relaxing section to the maintaining position and brings the relaxing-section driven rollers into contact with the relaxing-section drive rollers to set the relaxing section to the relaxing position.

9. The recording apparatus according to claim 1, wherein the relaxing section, in the relaxing position, protrudes from the transport path from an opposite side of the recording side of the medium to come into contact with the medium and in the maintaining position, retracts from the transport path.

10. The recording apparatus according to claim 9, wherein the relaxing section is a swing member having a pivot shaft on the upstream side in the medium transport direction, and the swing member extends from the pivot shaft side toward the downstream side in the medium transport direction in the width direction and a central section in the width direction becomes higher toward the downstream side in the medium transport direction.

11. The recording apparatus according to claim 10, wherein the relaxing section includes a plurality of swing members at positions corresponding to the crests of the corrugations in the medium at predetermined intervals.

12. The recording apparatus according to claim 11, wherein among the swing members in the relaxing section, the swing members that are close to the central section in the width direction are disposed on the upstream side in the medium transport direction and the swing members close to the end portion sides in the width direction are disposed on the downstream side in the medium transport direction.

* * * * *